US008166884B2

(12) United States Patent
Zheng et al.

(10) Patent No.: US 8,166,884 B2
(45) Date of Patent: May 1, 2012

(54) SWITCH ASSEMBLY FOR MAGNETIC LEVITATION RAILWAYS

(75) Inventors: Qinghua Zheng, Taufkirchen (DE); Friedrich Loeser, Riemerling (DE); Xiufei Liu, Poing (DE)

(73) Assignee: ThyssenKrupp Transrapid GmbH, Kassel (DE)

( * ) Notice: Subject to any disclaimer, the term of this patent is extended or adjusted under 35 U.S.C. 154(b) by 333 days.

(21) Appl. No.: 12/159,685

(22) PCT Filed: Jan. 10, 2007

(86) PCT No.: PCT/DE2007/000044

§ 371 (c)(1),
(2), (4) Date: Jun. 30, 2008

(87) PCT Pub. No.: WO2007/085223

PCT Pub. Date: Aug. 2, 2007

(65) Prior Publication Data

US 2009/0013898 A1 Jan. 15, 2009

(30) Foreign Application Priority Data

Jan. 24, 2006 (DE) ..... 10 2006 003 678

(51) Int. Cl.
*B61B 13/00* (2006.01)

(52) U.S. Cl. ..... 104/130.02; 104/130.03; 104/130.06; 104/130.11

(58) Field of Classification Search ..... 104/130.01, 104/130.02, 130.03, 130.06, 130.08, 130.11, 104/35, 38, 43, 44, 45; 105/29.1, 29.2; 238/123
See application file for complete search history.

(56) References Cited

U.S. PATENT DOCUMENTS

| | | | | |
|---|---|---|---|---|
| 1,585,337 | A * | 5/1926 | Feuerlein | 104/49 |
| 4,870,906 | A | 10/1989 | Schaffer et al. | |
| 5,287,811 | A * | 2/1994 | Matsuura et al. | 104/130.03 |

FOREIGN PATENT DOCUMENTS

| | | |
|---|---|---|
| DE | 34 20 260 | 12/1985 |
| DE | 10 2004 015 495 | 10/2005 |
| EP | 0 283 808 | 9/1988 |

OTHER PUBLICATIONS

"Magnetbahn Transrapid—Die Neue Dimension Des Reisens" (Transrapid Maglev—The New Dimension in Travel) Hestra-Verlag Darmstadt 1989, pp. 32-35 (With Eng. Abstract).

* cited by examiner

*Primary Examiner* — Mark Le
(74) *Attorney, Agent, or Firm* — Michael J. Striker

(57) ABSTRACT

A switch assembly for magnetic levitation railways includes a girder extending in a travel direction (x) and flexible transversely to it is provided with travel way or equipment parts. A rail and a rack are located transversely to the travel direction. A load-bearing frame, receiving the girder, has a rotatably supported carrying wheel braced on the rail and a drive mechanism with a gear wheel meshing with the rack and with a motor intended for driving it. Switch adjustment is effected by displacement of the load-bearing frame along the rail by means of the drive mechanism and a thus-effected flexing of the girder. The girder, the load-bearing frame and the drive mechanism form a solidly joined-together structural unit which as a whole is located displaceably in the travel direction (x) relative to the rail and the rack.

9 Claims, 4 Drawing Sheets

SWITCH ASSEMBLY FOR MAGNETIC LEVITATION RAILWAYS

CROSS-REFERENCE TO RELATED APPLICATION

The invention described and claimed hereinbelow is also described in German Patent Application DE 10 2006 003 678.6, filed on Jan. 24, 2006. The German Patent Application, whose subject matter is incorporated herein by reference, provides the basis for a claim of priority of invention under 35 U.S.C. 119(a)-(d).

BACKGROUND OF THE INVENTION

The invention relates to a switch assembly for use in magnetic levitation railways.

A switch assembly of the type of interest here comprises a so-called flexible switch (such as "Magnetbahn Transrapid—Die neue Dimension des Reisens" ["Transrapid Maglev—The New Dimension in Travel"], Hestra-Verlag Darmstadt 1989, pp. 32-35, DE 10 2004 015 495 A1). The essential component of such a flexible switch is a flexible steel girder that is 50 m long, for instance, or even longer and that bears the load of the travel way and equipment parts thereof. The girder is located in stationary fashion on one end and otherwise, by means of a plurality of load-bearing frames and carrying wheels mounted on them is supported movably on rails that are located transversely to its longitudinal direction, which is also the travel direction. For adjusting the switch, the load-bearing frames can be moved back and forth along the rails, as a result of which the girder is flexed and is aligned selectively with one of a plurality of travel ways that branch off from the switch.

For displacing the load-bearing frames, drive mechanisms have first been used, whose piston rods were pivotably connected to the load-bearing frames and whose cylinders were pivotably connected to stationary bearing blocks. However, since sealing problems and space problems inevitably arise when cylinder/piston assemblies are used, a switch assembly of the generic type described at the outset has already been disclosed as well. It has a rack, extending transversely to the travel direction, which meshes with a gear wheel that can be set to rotating, by means of a drive shaft located parallel to the longitudinal direction of the girder and driven by an electric motor mounted on the load-bearing frame. When the motor is on, the gear wheel rolls along the rack and in the process carries the entire drive mechanism, the associated load-bearing frame, and an associated girder portion along with it.

Because of the comparatively great length of the girder, in the construction of the switch assembly its possible change in length from temperature fluctuations must be taken into account as well. This purpose is served, in the switch assembly of the type defined at the outset, by dry slide bearings, by means of which the girder is braced on the load-bearing frames, and which make the requisite axial and rotary motions possible between the girder and associated parts of the load-bearing frames. The carrying wheels, guided movably on the rails and provided with wheel flanges on both sides, prevent motion of the load-bearing frames parallel to the travel direction, while the slide bearings allow expansion or contraction of the girder relative to the load-bearing frames in that direction. So that the motor when on will not rotate about the drive shaft, it is braced on the girder by means of at least one support element, and between the motor and the girder, there is a further dry slide bearing, which enables motions of the girder relative to the motor.

Because of the construction as described, the slide bearings that brace the girder have a plurality of functions. They must not only bear the weight of the girder but also enable relative motions between the girder and the load-bearing frames. As a result, comparatively long, stable slide bearings have to be provided, and therefore the entire apparatus comprising the girder and the load-bearing frames is relatively complicated and expensive. Since furthermore the girder may be comparatively large in all three dimensions, comparatively high strains can occur in the girder upon temperature fluctuations and especially an uneven amount of sunshine, and these stresses distribute the loads correspondingly unevenly to the slide bearings. This can lead to very high local loads on the slide bearings and in extreme cases to blockage of the slide bearings and furthermore to major noise production in the slide bearings. Under some circumstances this can shorten the service life of the slide bearings considerably.

SUMMARY OF THE INVENTION

With this as the point of departure, the object of the present invention is to embody the switch assembly as defined at the outset in such a way that the slide bearings between the girder and the load-bearing frames are dispensed with.

The invention has the advantage that the girder, the load-bearing frame, and the drive mechanism do not execute any motions relative to one another, but instead, upon thermal expansions and contractions of the girder simply go along with those motions. Instead, the carrying wheels on the rails and the gear wheels in the racks are displaceable parallel to the travel direction, so that upon temperature fluctuations, unwanted stresses cannot occur. Moreover, the attainment of this object of the invention has the consequence that because of the displaceable supporting of the carrying wheels on the rails and of the gear wheels in the racks, any nonuniformities of the associated portions of the girder in the flexing process, resulting from the fact that the rails and gear wheels do not always run along paths that correspond exactly to the paths of motion, deviating slightly from circular paths, can be compensated for.

Further advantageous characteristics of the invention are found in the dependent claims.

BRIEF DESCRIPTION OF THE DRAWINGS

The invention will be described in further detail below in conjunction with the accompanying drawings, in terms of an exemplary embodiment.

DESCRIPTION OF THE PREFERRED EMBODIMENTS

Figure 1:
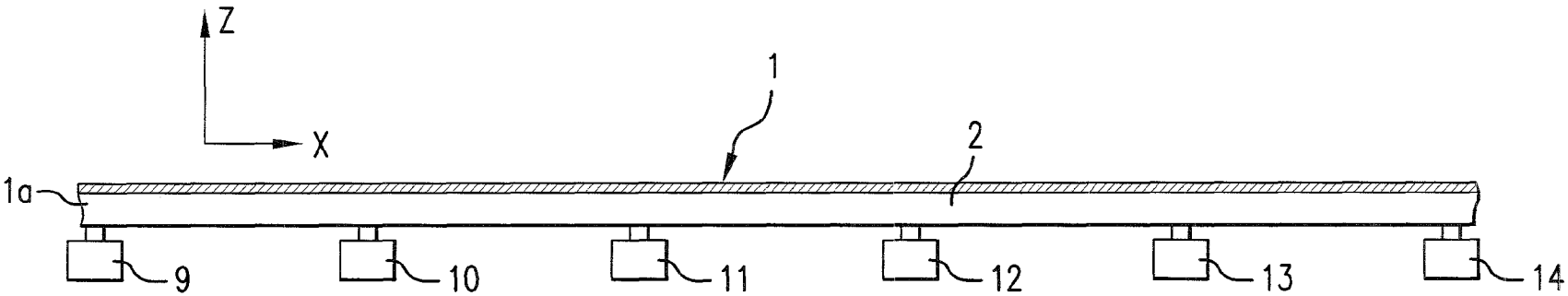
FIGS. 1 and 2, in a schematic side view and a top view respectively, show a switch assembly intended for magnetic levitation railways, with a flexible girder.

In FIGS. 1 through 6, a typical switch assembly in the form of a flexible switch for magnetic levitation railways includes a girder 1 extending over the entire length of the switch, for instance being approximately 78 m long. The girder 1 includes a load-bearing element 2 which extends in a longitudinal direction (=x direction) and which preferably comprises a box profile, that is, a hollow profile of rectangular cross section, in which the height is greater than the width. The load-bearing element 2, as shown especially in FIGS. 4 and 5, includes two strut plates or side parts 3 which in the installed state are located essentially vertically and perpendicularly to the ground. Between the side parts 3, transverse walls or bulkheads serving the purpose of reinforcement are provided. Cantilever arms or support plates 4 are secured to each side part 3, protruding from it at right angles, and on their ends, struts 5 are secured that extend parallel to the side parts 3 and that in the installed state are located vertically. In general, the travel direction of the vehicles along the girder 1 or in its longitudinal direction is called the x axis of an imaginary coordinate system, while the direction (width) extending transversely to it in which the support plates 4 extend is called the y axis, and the direction (height) perpendicular to both of these axes is called the z axis of the imaginary coordinate system.

Ribs located parallel to the support plates 4 and preferably in their extensions (y direction) are secured to the struts 5, and on the outer end faces of the ribs, equipment parts 6 are mounted, in the form of lateral guide rails that in the installed state are located vertically and that serve the purpose of tracking the vehicles. In the exemplary embodiment, one lateral guide rail is provided on each long side of the flexible girder 1, and the arrangement is preferably mirror-symmetrical to the x-z plane of the imaginary coordinate system.

On the top side of the girder 1, or of a cover plate 7 supported by it and by the support plates 4, two further equipment parts in the form of sliding strips are secured, which serve to set down the vehicles, and which like the equipment parts 6 extend over the full length of the girder 1, but in contrast to those, in the installed state, are located essentially horizontally. Finally, on the underside of the struts 5, the girder 1 is provided with equipment parts 8 in the form of stator carriers, which can comprise plates or blocks located transversely to the struts 5 and equipment parts 6 and serve for instance to secure the stator packets of a long-stator linear motor.

The parts 1 through 8 described are all of steel and are undetachably joined together, preferably by welding, forming the girder 1 that can be seen in FIGS. 1 through 6.

Figure 2:
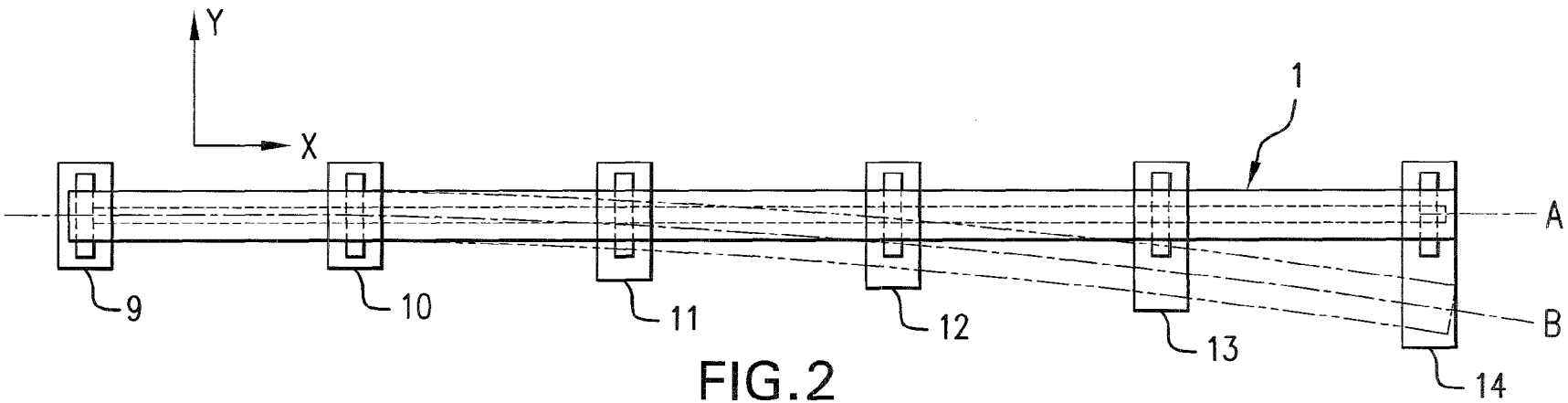

As can be seen from FIG. 2, for adjusting the switch assembly, the girder 1 is flexed continuously by a maximum of approximately 3.65 m, for example, from a straight-ahead travel way portion A to a branching travel way portion B. To that end, the girder 1 is supported on for instance six stanchions 9 through 14 that are anchored to the ground; one end 1*a* (see for instance FIGS. 1 and 6) of the girder 1 is solidly joined, in a manner not shown in detail, to a first stanchion, in this case the stanchion 9, while other portions of the girder 1 can be moved back and forth, transversely to the longitudinal direction and essentially horizontally, on the other stanchions 10 through 14, such as the stanchion 10 in FIGS. 3 and 5. This purpose is served in the region of each stanchion 9 through 14 by a load-bearing frame 15, mounted on or receiving the underside of the girder 1, which is mounted movably with the aid of carrying wheels 16 on rails 17. The weight of the girder 1 is therefore borne by the carrying wheels 16 and the rails 17.

Figure 7:
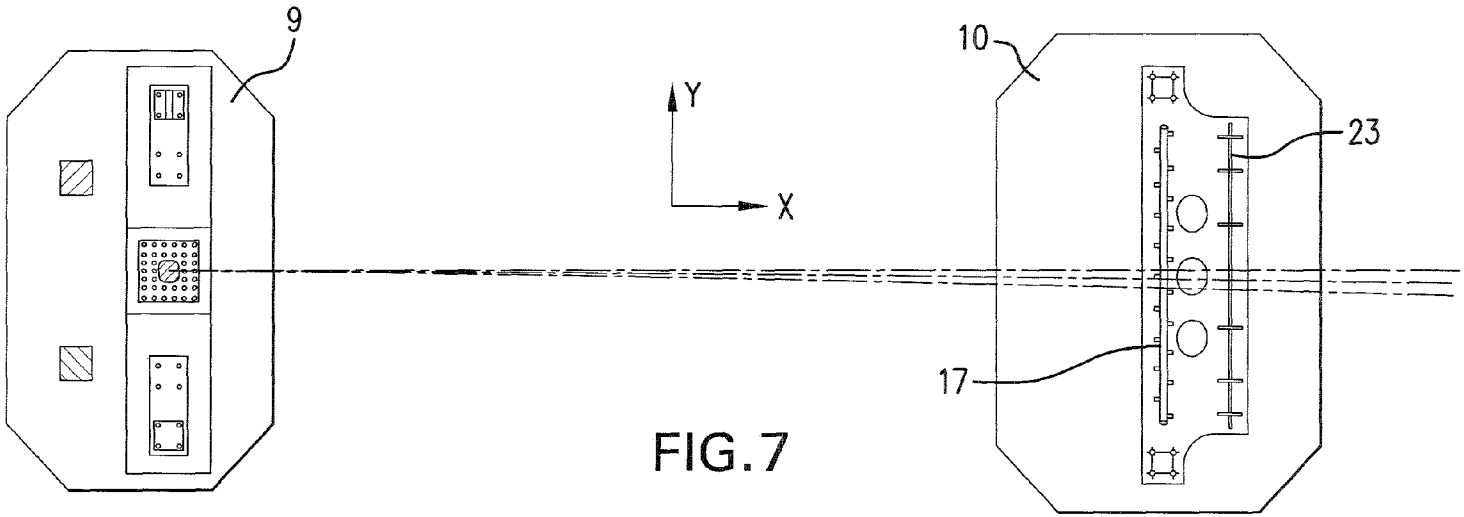
FIG. 7 is a schematic top view on two stanchions of the switch assembly of FIG. 6, without showing a girder and load-bearing frames for it'

The rails 17, as FIG. 7 for instance shows, in a top view without the girder 1 and the load-bearing frame 15, are located on the applicable stanchions 10 through 14, extend substantially in the y direction, and are embodied as slightly curved. The curvature of each of the rails 17 is defined to suit the constructed flexing curves of the girder 1; that is, they are dimensioned essentially in accordance with those paths along which the portions of the girder 1 that are braced on the associated load-bearing frames 15 move when the girder, with a stationary end 1*a*, is flexed by motion of the applicable load-bearing frames 15 in the y direction.

Figure 3:
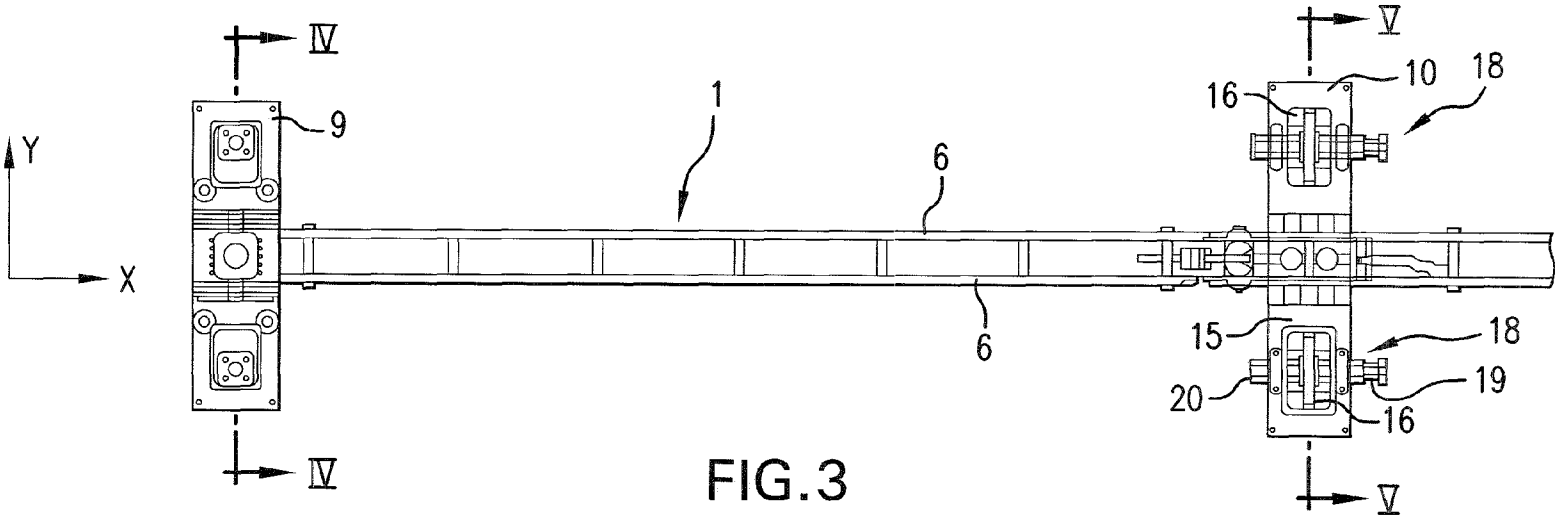
FIG. 3 is a schematic top view on a switch assembly according to the invention.
Figure 5:
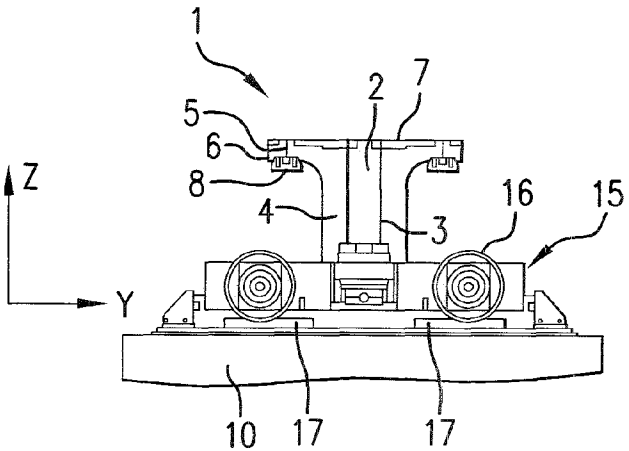
FIGS. 4 and 5 are schematic cross sections, rotated by 90°, along the lines IV-IV and V-V of FIG. 3.
Figure 4:
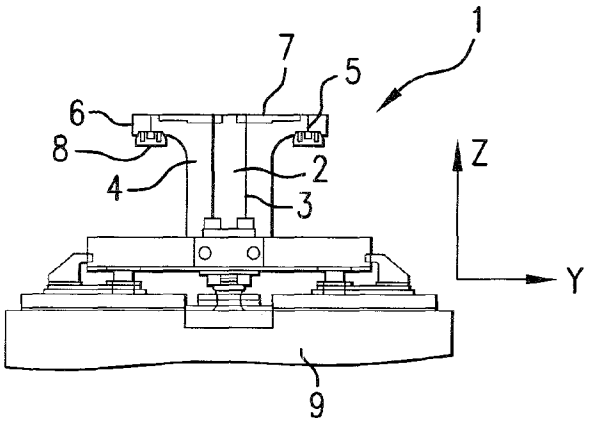
Figure 6:
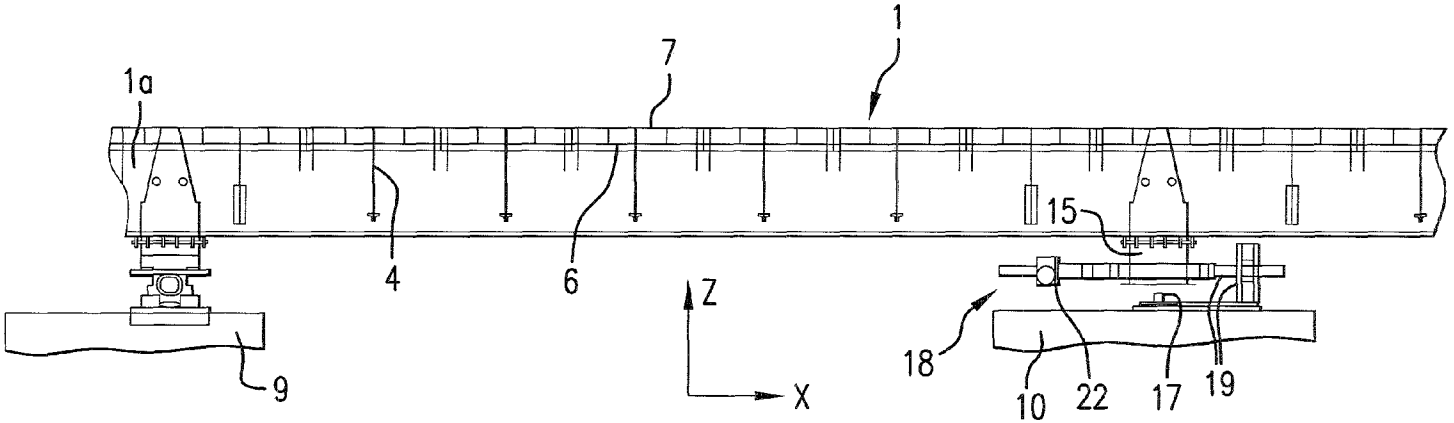
FIG. 6 is a schematic side view of the switch assembly according to the invention in the direction of an arrow v of FIG. 3.
Figure 8:
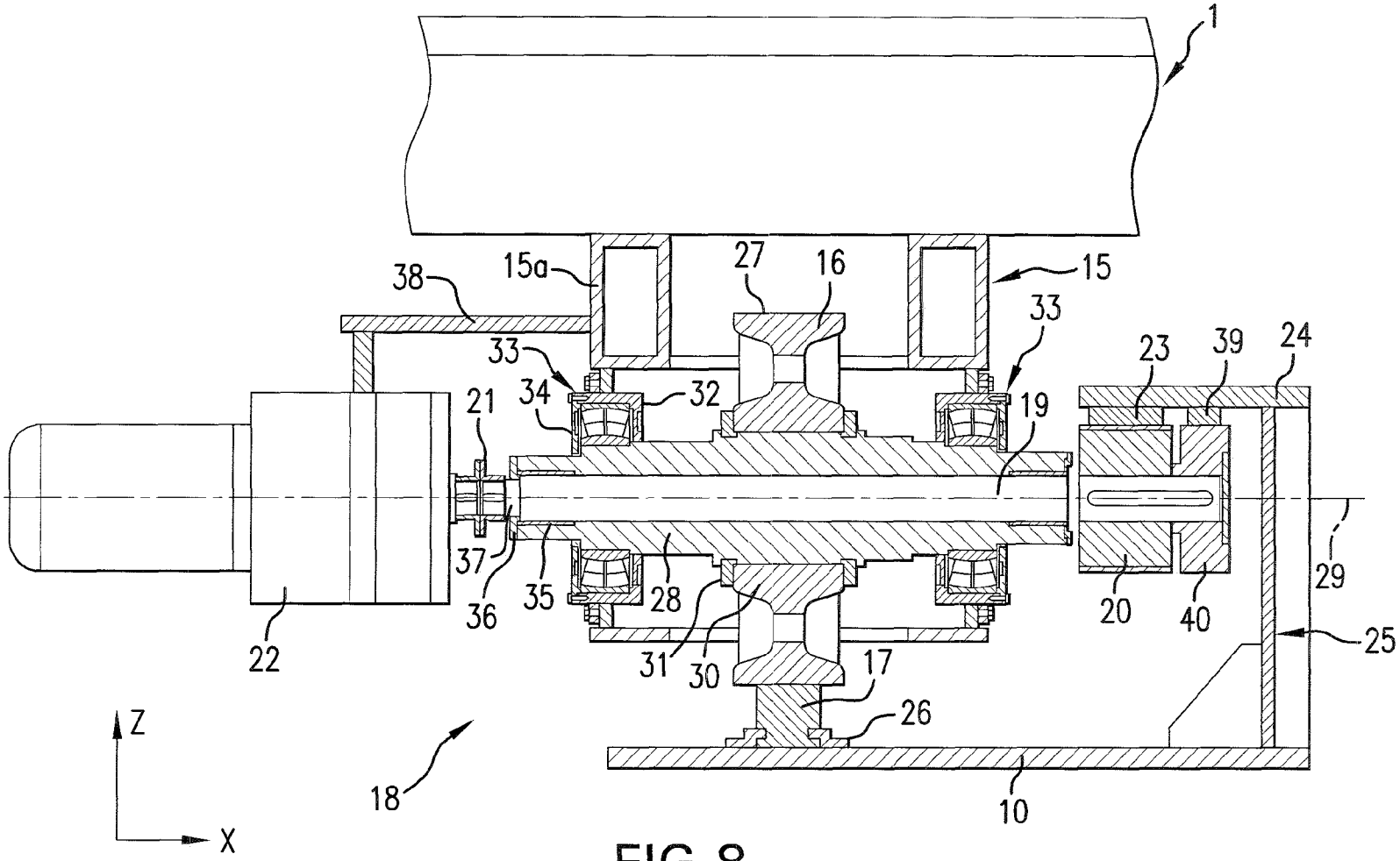
FIG. 8 is a highly enlarged longitudinal section through a load-bearing frame of FIG. 6 and a drive mechanism of the switch assembly according to the invention.

For displacing the load-bearing frames 15 in the y direction, a drive mechanism 18 connected to them is used, for instance as shown in FIGS. 3, 6 and 8. It includes a drive shaft 19, extending approximately parallel to the travel direction or longitudinal direction, which is solidly connected on one end to a gear wheel 20 and on the other, via a coupling 21, to the power takeoff shaft of a motor 22, in particular an electric motor. The gear wheels 20 of the various drive mechanisms 18 each mesh with a respective rack 23 (FIG. 8), which is located transversely to the travel direction and essentially parallel to the applicable rail 17 (FIG. 7). The racks 23 have a curvature corresponding substantially to the associated rail 17 and are secured to the undersides of a respective retention plate 24 (FIG. 8), which is borne by a stand 25 mounted on the applicable stanchion (such as 10) and protruding from it. Therefore if the motors are switched on and the drive shafts 19 are set into rotation in one or the other direction of rotation, then the gear wheels 20 roll on the racks 23 associated with them and thus, as described in further detail hereinafter, move the associated load-bearing frames 15 and with them the portions resting on them of the girder 1 in the y direction. As a result, the girder 1 is flexed in the manner visible in FIG. 2 and is adjusted to one of the at least two travel ways A and B.

As seen from FIG. 2, for adjusting the switch assembly, at least one load-bearing frame 15 is required, which is displaceable transversely to the travel direction in the manner described. In actuality, depending on the length of the girder 1, however, at least a plurality of such load-bearing frames 15 is provided. All of these load-bearing frames 15 and the units required for displacing them can be embodied essentially identically, so that below, in conjunction with FIG. 8, only those structural units that are associated with the stanchion 10 will be described in detail, as examples. Moreover, FIG. 3, for instance, shows that in the exemplary embodiment, two identical drive mechanisms 18 are provided, one on each side of the girder 1, which each drive one carrying wheel 16 of the applicable load-bearing frame 15. These two drive mechanisms 18 are also essentially structurally identical, so that hereinafter, only one of these drive mechanisms 18 will be described in detail.

According to the invention, the girder 1, the load-bearing frame 15, and the drive mechanism 18 mounted in the load-bearing frame 15 form a solidly joined-together structural unit, which is located displaceably in the travel direction (x axis) as a whole relative to the rail 17 and to the rack 23. On the one hand, the rail 17 is secured by fastening means 26, and the rack 23 is secured by means of the stand 25, in both cases rigidly and immovably to the associated stanchion 10. On the other hand, each carrying wheel 16, in contrast to known constructions, has no double wheel flange or wheel flange disposed on both sides, but instead has only a smooth, preferably cylindrical, slightly conical or even spherical circumferential surface 27. The carrying wheel 16 can therefore not only roll on the rail 17 in the y direction but can also be displaced with sliding friction on the rail 17 transversely to it, that is, in the x direction. Correspondingly, the flanks of the gear wheel 20 and of the rack 23 are embodied such that the gear wheel 20 can go along with any displacement of the carrying wheel 16 in the x direction by being displaced in the rack 23, likewise in the x direction. The purpose of these provisions will be described hereinafter.

In FIG. 8, the load-bearing frame 15 includes a hollow shaft 28, with a center axis 29 extending parallel to the x direction. The hollow shaft 28 protrudes coaxially through a hub 30 of the carrying wheel 16 and is connected to this hub 30, with the aid of further fastening means 31, in a manner fixed against relative rotation as well as axially and radially fixed, so that relative motions between the carrying wheel 16 and the hollow shaft 28 are impossible.

The load-bearing frame 15 in FIG. 8 has a frame or mounting part 15*a*, secured to the underside of the girder 1, which has two bearing portions 32, spaced apart in the x direction, that are located on both sides of the carrying wheel 16. These bearing portions 32 for instance comprise housings of axial bearings 33, in which portions of the hollow shaft 28 that are located on both sides of the carrying wheel 16 are rotatably supported. The axial bearings 33 are preferably embodied as pendulum bearings, which connect the girder 1 and the hollow shaft 28 solidly and nondisplaceably to one another axially (in the x direction), but allow relative rotary motions and also slight pendulum motions between the girder 1 and the hollow shaft 28. As a result, possible deformation of the girder 1 from uneven temperature distributions can be compensated for. As FIG. 8 shows, the axial bearings 33 are closed off toward the outside by caps 34.

In the described exemplary embodiment of the invention, which at present is considered to be the best one, the drive shaft 19 protrudes coaxially through the hollow shaft 28, in such a way that its end that carries the gear wheel protrudes from one end of the hollow shaft 28, and its end connected to the coupling 21 protrudes from the other end of the hollow shaft. Moreover, the drive shaft 19 is preferably supported slightly rotatably in the hollow shaft 28 by at least two radial slide bearings 35. Additional, axial slide bearings 36 are present on the terminal end faces of the hollow shaft 28; they cooperate with graduated portions 37 of the drive shaft 19 and are closed off toward the outside by further caps. The arrangement overall is therefore such that the hollow shaft 28 and the drive shaft 19, while axially nondisplaceably joined to one another, are connected rotatably to one another.

The motor 22, by means of a stanchion 38, is connected axially nondisplaceably and in a manner fixed against relative rotation to the girder 1, or the mounting part 15*a* connected with it. As a result, on the one hand rotations of the motor 22 about the center axis 29, but on the other, axial relative motions between the motor 22 and the girder 1, are prevented.

The mode of operation of the arrangement described in conjunction with FIG. 8 is essentially as follows.

An adjustment of the switch assembly is effected such that the motor 22 is switched on, in order to set the drive shaft 19 to rotating in the desired direction of rotation. As a result, on the one hand, the gear wheel 20 rolls on the rack 23 in the y direction, while on the other, the drive shaft 19, the hollow shaft 28 coupled to it, and the carrying wheel 16 secured thereon go along with this motion, so that the carrying wheel 16 rolls on the rail 17, with corresponding flexing of the girder 1. The resultant different rotary speeds and directions of the gear wheel 20 and carrying wheel 16 are made possible by corresponding relative rotations between the shafts 19, 28 by means of the slide bearings 35. Along with the hollow shaft 28, the portion supported by it of the girder 1 is also moved in the y direction. The same is correspondingly true for all the load-bearing frames 15 present, which are actuated essentially simultaneously, so that the switch assembly is adjusted in the way that has been described above in conjunction with FIG. 2. Once the new switch position is reached, it is locked, by means not shown but known per se.

In the event that because of major temperature fluctuations the girder 1 expands or contracts in the x direction, the consequence is first that the stanchion 38 and therefore also the motor 22 and the drive shafts 19 go along with this motion, and the gear wheel 20 can slide in the x direction in the rack 23. Second, however, the bearing portions 32 of the load-bearing frame 15 and with them the hollow shaft 28 and the carrying wheel 16 are also moved in a corresponding way in the x direction, and the circumferential surface 27 of the carrying wheel 16 can be displaced on the rail 17 parallel to the x direction. The girder portions affected by thermal expansions and contractions can therefore move in the x direction together with the drive mechanisms 18 (formed in particular by the gear wheel 20, drive shaft 19, and motor 22) and with the load-bearing frame 15 (formed in particular by the hollow shaft 28, carrying wheel 16, and axial bearing 33), so that no relative motions are required among these structural groups. It is clear that the widths of the carrying wheel 16, the rail 17, the gear wheel 20, and the rack 23 are preferably selected such that even in the event of extreme thermal expansion or contraction of the girder 1, full contact between the parts 16, 17 and 20, 23 is always assured.

The invention is not limited to the exemplary embodiment described, which could be modified in manifold ways. This is true in particular for the construction described in conjunction with FIG. 8. Alternatively, it would for instance be possible to support the carrying wheel 16 axially nondisplaceably, yet rotatably, on the hollow shaft 28, and instead to secure the girder 1 nonrotatably to the hollow shaft 28. Lengthwise expansions and contractions of the girder 1 would have exactly the same effect in this case as is described above. The sole distinction would be that the hollow shaft 28 would not rotate with the carrying wheel 16 upon adjustment of the switch assembly; the axial bearings 33 would be dispensed with, and instead, suitable rotary bearings would be provided for the carrying wheel 16. A further variant could be that the motor 19 in FIG. 8 is mounted on the side of the stand 25 on the girder 1, and the drive shaft 19 is located and supported outside the hollow shaft 28. In these two variants as well, the girder 1, the load-bearing frame 15, and the drive mechanism 18 each form a structural unit that is displaceable as a whole relative to the rail 17 and to the rack 23, so that the axial position of the load-bearing frame 15 and of the drive mechanism 18 is defined by the girder 1, and not as before by the rail 17. It is further clear that per stanchion 10 through 14 and per load-bearing frame 16, more than one carrying wheel 16 may be provided, as shown for instance in FIGS. 3 through 5, in which there are two carrying wheels 16 each. It is possible to assign each carrying wheel 16 its own drive mechanism 18, whose gearwheels 20 can mesh with the same racks or different racks 23. Moreover, per stanchion 10 through 14, two or more load-bearing frames 15 could be present, which have carrying wheels 16 rolling on the same or different rails 17. However, since all of these parts, which under some circumstances may be multiply present, are located, supported and moved in the same way according to the invention, only one of these parts is mentioned in the above description and in the ensuing claims. It is implicitly a condition that this wording also includes the presence of two or more corresponding parts. It may furthermore be expedient to ensure the flexing motion of the girder 1 in a defined plane by providing that beneath the retention plate 24, a guide rail 39 is mounted, and a pressure roller 40 secured to the drive shaft 19 rolls on the underside, which defines the defined plane, of the guide rail. In this case the arrangement is analogous to what is described above, so that the pressure roller 40 can also be moved in the x direction relative to the guide rail 39, if that is necessary because of thermal expansion or contraction of the girder 1. Finally, it is understood that the various characteristics may also be employed in different combinations from those described and shown.

The invention claimed is:

1. A switch assembly for magnetic levitation railways, including:

a girder (1), extending in a travel direction (x) and flexible transversely to the travel direction (x), which girder (1) is provided with travel way or equipment parts (6, 8);

a rail (17) located transversely to the travel direction (x);

a rack (23) located transversely to the travel direction (x); and a load-bearing frame (15), receiving the girder (1), that has a rotatably supported carrying wheel (16) braced on the rail (17) and a drive mechanism (18) with a gear wheel (20) meshing with the rack (23) and with a motor (22) intended for driving it, wherein switch adjustment is effected by displacement of the load-bearing frame (15) along the rail (17) by means of the drive mechanism (18) and a thus-effected flexing of the girder (1), characterized in that the girder (1), the load-bearing frame (15), and the drive mechanism (18) form a solidly joined-together structural unit which as a whole is located displaceably in the travel direction (x) relative to the rail (17) and to the rack (23).

2. The switch assembly as defined by claim 1, characterized in that the load-bearing frame (15) has a hollow shaft (28) that is solidly connected to the carrying wheel (16) and is penetrated by a drive shaft (19), which is solidly joined to the motor (22) on one end and to the gear wheel (20) on the other.

3. The switch assembly as defined by claim 1, characterized in that the motor (22) is secured by means of a support element (38) solidly joined to the girder (1) or to a mounting part (15*a*) of the load-bearing frame (15).

4. The switch assembly as defined by claim 2, characterized in that the load-bearing frame (15) has a bearing portion (32) in which the hollow shaft (28) is rotatably supported by means of an axial bearing (33).

5. The switch assembly as defined by claim 4, characterized in that the axial bearing (33) is embodied as a pendulum bearing.

6. The switch assembly as defined by claim 2, characterized in that the drive shaft is rotatably supported in the hollow shaft (28) with the aid of radial slide bearings (35).

7. The switch assembly as defined by claim 2, characterized in that the drive shaft (19) is supported rotatably, but axially nondisplaceably, in face ends of the hollow shaft (28) with the aid of axial slide bearings (36).

8. The switch assembly as defined by claim 1, characterized in that the carrying wheel (16) is a wheel that is displaceably transversely to the rail (17) and has no wheel flange.

9. The switch assembly as defined by claim 1, characterized in that the gear wheel (20) is displaceable transversely to the rack (23).

* * * * *